United States Patent [19]

Gimond et al.

[11] 4,426,068

[45] Jan. 17, 1984

[54] ROTARY GAS DISPERSION DEVICE FOR THE TREATMENT OF A BATH OF LIQUID METAL

[75] Inventors: Jacques Gimond, Grenoble; Richard Gonda, Le Grand Lemps; Jean-Marie Hicter, Coublevie; Pierre Laty, Compiegne, all of France

[73] Assignee: Societe de Vente de l'Aluminium Pechiney, Paris, France

[21] Appl. No.: 402,158

[22] Filed: Jul. 26, 1982

[30] Foreign Application Priority Data

Aug. 28, 1981 [FR] France ..... 81 16735

[51] Int. Cl.[3] ..... C22B 9/00

[52] U.S. Cl. ..... 266/217; 266/225; 266/235; 75/68 R

[58] Field of Search ..... 266/217, 225, 235, 265; 75/93 E, 93 R, 68 R; 261/87; 422/231, 225

[56] References Cited

U.S. PATENT DOCUMENTS

| | | | |
|---|---|---|---|
| 3,792,848 | 2/1974 | Ostberg | 266/235 |
| 4,040,610 | 8/1977 | Szckely | 266/235 |
| 4,178,175 | 12/1979 | Narita | 266/217 |

FOREIGN PATENT DOCUMENTS

| | | | |
|---|---|---|---|
| 341851 | 5/1970 | U.S.S.R. | 266/235 |

*Primary Examiner*—M. J. Andrews

*Attorney, Agent, or Firm*—McDougall, Hersh & Scott

[57] ABSTRACT

The invention relates to a rotary gas dispersion device for the treatment of a bath of liquid metal such as aluminum and its alloys, comprising a cylindrical rotor equipped with blades immersed in the bath, connected to a hollow control shaft for the supply of gas, and is characterized in that the rotor is pierced by oblique ducts coupled to radial ducts in which the metal and the gas circulate respectively before being mixed at the point where these ducts join up, emerging in the bath so as to form a fine dispersion which is then distributed in the said bath by means of blades.

7 Claims, 3 Drawing Figures

ROTARY GAS DISPERSION DEVICE FOR THE TREATMENT OF A BATH OF LIQUID METAL

The present invention relates to a rotary gas dispersion device for the treatment of a bath of liquid metal and, in particular, of aluminum and its alloys.

The skilled in the art knows that, before molding semi-finished metallurgical products, it is necessary to treat the unrefined metal to free it from dissolved gases and non-metallic impurities which it contains, the presence of which would impair the desired properties and the solidifying capacity of the manufactured articles.

Two principal methods of treatment are known at present. The first comprises passing the liquid metal through inert or active filtration media which retain the impurities either mechanically or chemically or by exerting both effects. The second method makes use of inert or reactive gases or of a mixture thereof, which are mixed fairly intensively with the liquid metal in the presence or absence of products such as fluxes. These two methods can also be combined.

As regards the second method, numerous developments have been made, among other things, in the manner of introducing the gas into the metal bath and the manner of achieving better dispersion of the gases in the liquid, in the knowledge that the effectiveness of the treatment is related to the interface between the two phases.

Thus, according to French Patent No. 1 555 953, the gas is introduced into the bath by a plunger of which the lower portion is equipped with a rotary device permitting the stirring and distribution of the gas through a large surface of the bath.

According to French Patent No. 2 063 916, the gas is blown into the molten metal by means of a water-cooled nozzle with a double casing.

According to French Patent No. 2 166 014, the gases are injected in the form of small discrete bubbles by means of a device comprising a rotary shaft integral with a finned rotor, a stationary bush surrounding the said shaft and connected at its lower end to a finned stator. The shaft and bush are separated by an axial passage in which the gases are transported and then introduced at the level of the fins where they are subdivided into small bubbles and brought into contact with the metal stirred by the rotor.

According to French Patent No. 2 200 364, the gas is introduced at the center of rotation of a turbine stirrer and brought into contact with the liquid metal under stirring conditions which avoid emulsification.

Numerous other solutions have also been proposed for introducing the gas in the form of very small bubbles. However, although each solution has specific advantages, they all have the disadvantage of leading to irregular dispersion of the gas bubbles in the liquid metal.

In fact, although each gas bubble emitted may be small at the moment of formation, and may give rise initially and locally to the formation of a fine dispersion, it expands rapidly as it travels in the bath by coalescence with other bubbles and thus forms a coarse dispersion. The liquid-gas exchange is particularly reduced in the portions of the bath which have not been in contact with the gas at its point of emission, so the effectiveness of the treatment is uncertain. As this phenomenon of coalescence cannot be avoided, it is necessary to find a system in which each of the elements of the volume of the liquid constituting the entire bath to be treated can form with the gas this fine dispersion which is desirable for achieving optimum effectiveness.

It is an object of this invention to provide a rotary gas dispersion device for the treatment of a bath of liquid metal which is of simple design and therefore of easy and strong construction, with which the entire bath, circulating between the inlet and outlet of the vessel containing it, is resolved into a number of liquid jets on which the gas continuously exerts the effect of penetration, so that the entire mass of liquid receives at some time, during the treatment, this diphasic (liquid-gas) state of dispersion.

This rotary gas dispersion device for the treatment of a bath of liquid metal contained in a vessel comprises a cylindrical rotor equipped with blades immersed in the bath and connected to a hollow drive shaft for the supply of gas, and is characterized in that the rotor is pierced by pairs of ducts, each pair comprising one duct which permits the passage of the liquid and the other which permits the passage of the gas, each of the pairs opening separately at the same point on the lateral surface of the cylinder so as to form at this point a fine liquid-gas dispersion which is then distributed in the bath by means of the blades.

The device according to the invention therefore comprises kown elements, that is to say a cylindrical rotor equipped on its lateral wall with blades of any contour which are placed symmetrically about the rotational axis and are arranged, either vertically or obliquely, so as to form an upwardly or downward propeller. This rotor is connected by its center, in its axial direction, to the lower portion of a drive shaft of which the upper end is connected via a speed reducer to a motor which imparts to it a rotational movement.

This shaft is hollow so as to bring to the level of the rotor a gas which is admitted at its upper end by means, for example, of a pipe provided with a rotary joint. This shaft is preferably composed of two different materials: one for the portion immersed in the bath and which is generally graphite, and the other for the emerging portion and which may be a corrosion-resistant metal alloy if the treatment gas contains chlorine, for example. This portion of the shaft may be provided with cooling fins to prevent an excessive rise in temperature which would harm the stability of the gas supply equipment and the driving mechanism.

The special feature of the device lies in the presence, inside the rotor which is usually made of graphite, of pairs of gas circulation ducts and metal circulation ducts pierced in the mass and arranged in an original fashion.

Thus, with regard to the gas circulation ducts, they are placed radially and they all join up in the center of the rotor at a point connected to the hollow portion of the shaft either directly or via a chamber. They all open into the bath on the lateral wall of the cylinder, preferably between two blades. Their cross-section, which is generally circular, is small and varies depending on the gas pressure adopted and on the flow rate of the gas to be passed, but diameters of between 0.1 to 0.4 cm can preferably be selected.

The liquid metal circulation ducts generally have an oblique direction relative to the axis of the rotor and traverse the rotor from one side to the other, originating either on its lower face or on its upper face and opening on its lateral face at the precise point where the gas circulation ducts open. This direction is generally inclined at between 10° and 60° to the horizontal. Their cross-section, which is generally circular, is larger than that of the gas ducts and also varies depending on the flow rate of metal to be treated, but a diameter of between 0.5 and 1.5 cm is preferably suitable.

Since the number of ducts of the two types is the same, each gas duct is connected to a liquid duct, forming an assembly of pairs of ducts having a common point of emergence in the bath.

In operation, under the influence of the centrifugal force generated by the rotation, the liquid metal moves in the appropriate ducts. This movement takes place from bottom to top or from top to bottom, depending on whether the liquid ducts start on the lower face or upper face of the rotor. The flow rate obtained depends on the rotational speed of the rotor, the number of ducts, the cross-section thereof, their inclination to the vertical, the difference in level between their ends, and the distance between the point where they start and the center of the rotor.

Once the hollow shaft is connected to a source of gas under pressure, a flux is produced in the gas ducts which, owing to the small cross-section of the ducts, gives rise to very high speeds at the point where the jets of liquid open into the bath. This results in a fine dispersion of the two phases and intimate mixing between the gas and the metal over the entire outlet cross-section of the liquid duct.

The mixture thus produced, appearing at the lateral surface of the rotor, is immediately distributed by means of the blades in the entire bath where exchange reactions take place and before the gas bubbles expand due to coalescence and burst at the surface of the bath.

Owing to numerous parameters affecting the flow rate of liquid, it is always possible to adjust them to certain values so as to achieve complete treatment of the entire flow of metal to be treated. Similarly, the gas flow rate can be adjusted to the values normally accepted for the treatment of a given quantity of metal. Owing to these possibilities of adjusting the geometric parameters indicated above, the rotational speeds can be limited to low values, with the advantage of simplifying the design of the driving mechanism and thus improving the stability of the equipment over time.

The value of such a device, compared with the other gas propellers proposed up until now, can be seen since, in addition to the stirring by the blades, the mass of metal to be treated is renewed continually and completely at the precise point where the treatment gas is injected. Hence there is a maximum gas-liquid exchange surface and consequently optimum effectiveness of the treatment.

Such a device according to the invention can be placed in any vessel of which the contents are to be treated, whether it be a casting ladle, a continuously or intermittently operating maintenance or production furnace, whether or not it be equipped with intermediate partitions, whether or not it employs fluxes, whether the gases used be nitrogen, argon, chlorine or mixtures thereof or vapors of halogenated derivatives or any other gaseous product capable of having a favorable influence on the purification of the metal.

Depending on the treatment desired, the flow rate to be treated and the desired duration of the treatment, it is possible to use several devices, whether they be positioned on a single vessel or on several vessels placed in series or in parallel.

The invention will be understood better by means of the accompanying drawings which are intended simply to illustrate but not to limit the scope of the present invention.

Figure 1:
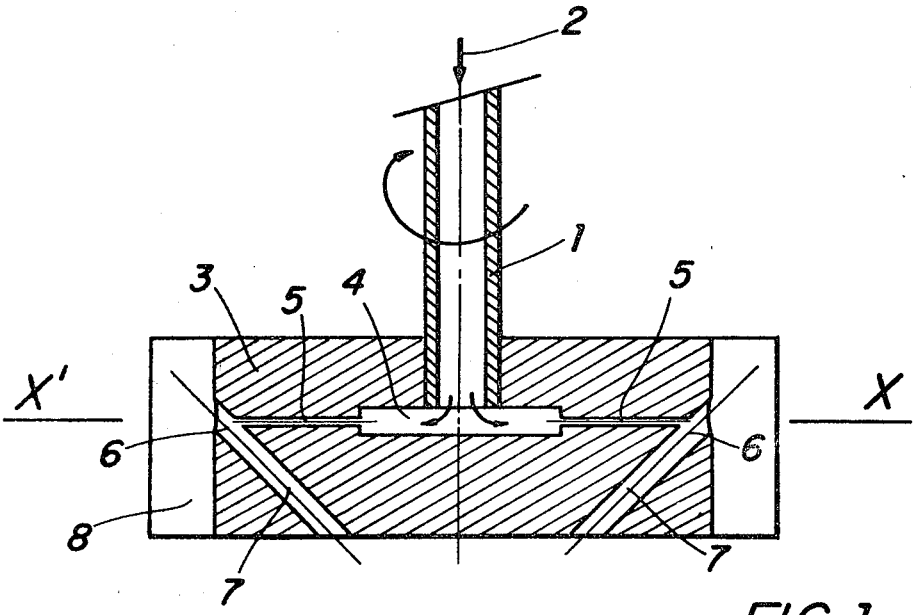
FIG. 1 is a vertical sectional view through the device along a plane passing through the rotational axis and the axes of two pairs of ducts.

FIG. 1 shows a hollow drive shaft 1 through which the gas 2 is brought to the level of the rotor 3 via a chamber 4 provided at its periphery with ducts 5 which open at 6 at the precise point where the ducts 7 end, the latter ducts extending through the rotor from the lower face of the rotor, and through which the liquid metal flows to form the fine liquid-gas dispersion which is then dispersed in the bath by the blades 8.

Figure 2:
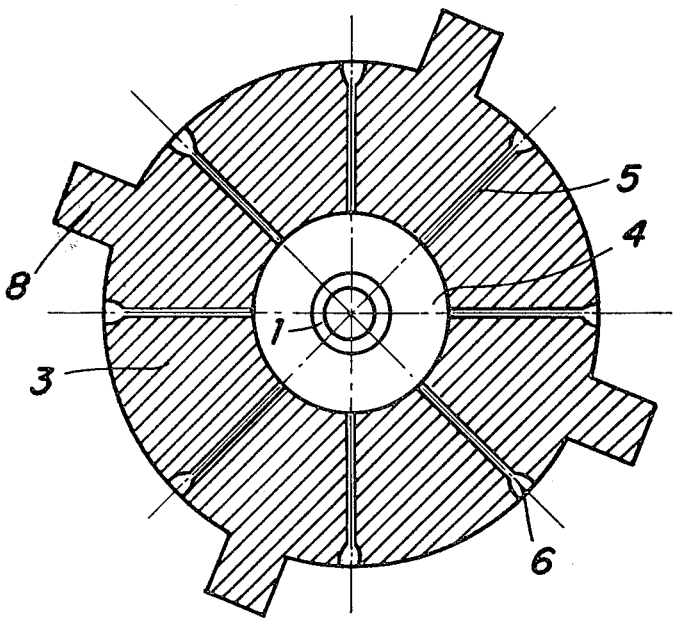
FIG. 2 is a horizontal sectional view of the device, taken along the line X'X in FIG. 1.

FIG. 2 shows at 1 the lower end of the hollow shaft at the point where it is connected to the chamber 4 of the rotor 3 pierced by the ducts 5 permitting the passage of the gas, which exits into the bath at 6 at the same point as the ducts permitting the passage of the liquid and where the fine liquid-gas dispersion is distributed in the bath by the blades 8.

Figure 3:
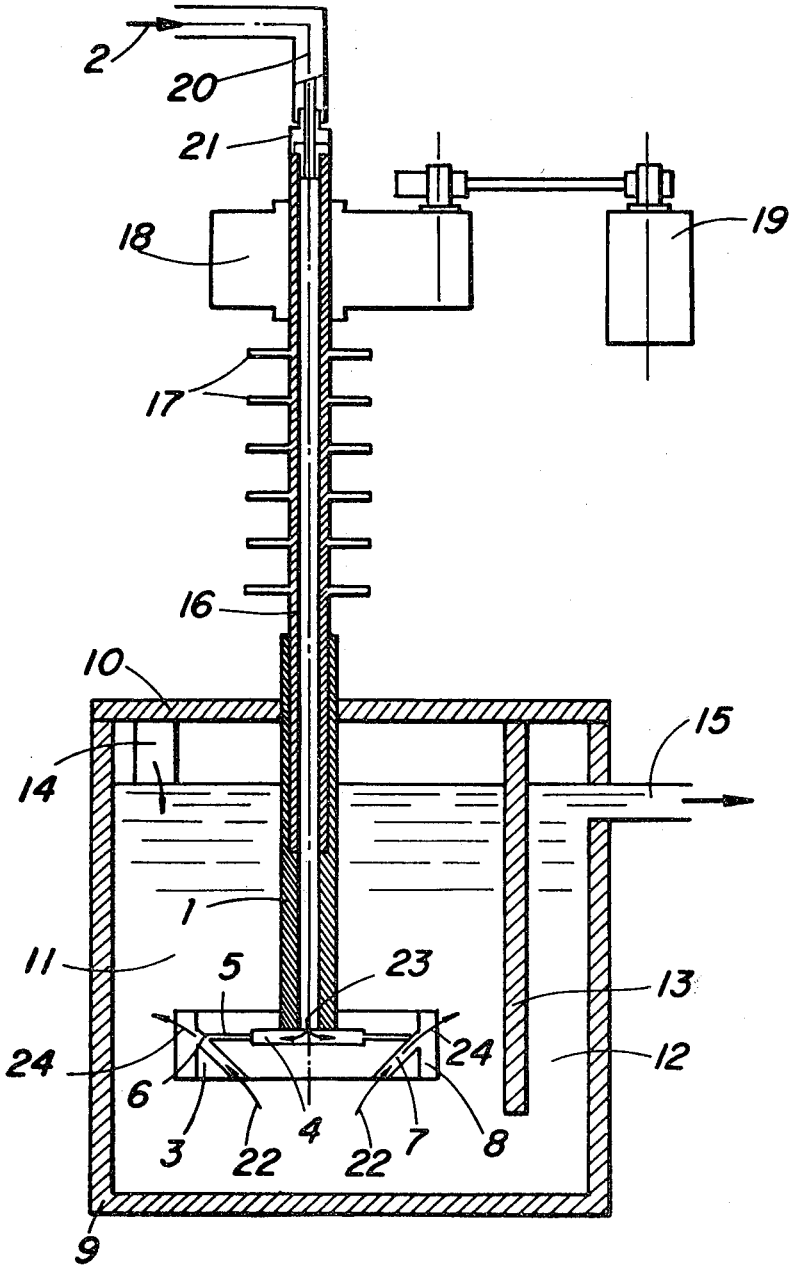
FIG. 3 is a vertical sectional view through the device installed on a continuous casting ladle.

FIG. 3 shows a casting ladle 9 which is closed by a lid 10, divided into an upstream compartment 11 and a downstream compartment 12 by a partiton 13, and which is supplied with liquid via the inlet spout 14 and drained via the outlet spout 15.

During its passage through the ladle between 14 and 15, the liquid is subjected to the action of the device according to the invention comprising the rotor 3 provided with its ducts 5 and 7 opening in the bath at 6 and with blades 8, connected via the chamber 4 to the hollow shaft composed of a graphite portion 1 which is bushed at its upper portion to a metal shaft 16 equipped with cooling fins 17 driven by a reducer 18 controlled by a motor 19 and connected to piping 20 via a rotary joint 21 so as to be able to admit the gas 2 originating from an external source.

During the rotation of the device, the liquid enters the ducts 7 in the directions indicated by the arrows 22, and rises to 6 where it meets the gases admitted into the chamber 4 in the directions indicated by the arrows 23 which issue via the ducts 5 so as to form a fine dispersion which is distributed in the bath by the blades 8 in the direction indicated by the arrows 24.

The present invention is illustrated by the following example of use. A ladle having a diameter of 60 cm and a height of 1 m was equipped with a graphite rotor having a diameter of 20 cm and a height of 8 cm.

The rotor is provided with eight ducts 7 which permit the passage of the metal, have a diameter of 1 cm and a length of 7 cm and are inclined at 45° to the vertical, and with eight ducts 5 permitting the passage of the gas which pierce the rotor horizontally and have a diameter of 0.1 cm.

6 tons per hour of a 2014 type aluminum alloy were circulated in the ladle. The rotor turned at a speed of 150 r.p.m. and 4 $Nm^3/h$ of a mixture containing 95% by volume of argon and 5% by volume of chlorine was injected.

The alloy was very gaseous at the entrance of the ladle and had a hydrogen content of 0.85 cc/100 g measured by a vacuum test under a pressure of 2 Torr. At the outlet, on subjecting this alloy to the same test, a content of only 0.14 cc/100 g was observed and no appearance of bubbles, demonstrating the effectiveness of the treatment achieved by means of the claimed device.

The present invention can be applied whenever good dispersion is selected in liquid-gas diphasic mixtures. This is the case in the treatment of liquid metals and, in particular, of aluminum or its alloys with the aim of eliminating the hydrogen and non-metallic impurities.

We claim:

1. A rotary gas dispensing device for treatment of a bath of liquid metal which is contained in a vessel, said device comprising a hollow shaft, means for communicating the hollow shaft with a source of gas, a rotor of cylindrical shape mounted on the hollow shaft, a plurality of blades mounted on the periphery of the rotor and extending outwardly therefrom, a plurality of pairs of ducts defined by the rotor, each said pair comprising one duct communicating with the hollow shaft and extending outwardly therefrom to said periphery, the other duct of each pair communicating with said bath at a location inwardly of said periphery and extending to and intersecting said one duct of that pair.

2. A device as claimed in claim 1 in which said one duct for the passage of gas extends through the rotor in the radial direction.

3. A device as claimed in claim 1 in which said other duct for the passage of liquid metal extends through the rotor in an oblique direction relative to the horizontal.

4. A device as claimed in claim 3 in which said other ducts for the passage of the metal are inclined at an angle within the range of 10°–60° to the horizontal.

5. A device as claimed in claim 1 in which said other ducts for the passage of the metal are of circular cross section and have a diameter within the range of 0.5 to 1.5 cm.

6. A device as claimed in claim 1 in which said one ducts for the passage of the gas are of circular cross section and have a diameter within the range of 0.1 to 0.4 cm.

7. A device as claimed in claim 1 in which said blades are distributed symmetrically about the rotational axis over the outer wall of the rotor and between the outlets of the ducts.

* * * * *